US008894438B2

(12) United States Patent
Schmitt et al.

(10) Patent No.: US 8,894,438 B2
(45) Date of Patent: Nov. 25, 2014

(54) RECEPTACLE ASSEMBLY HAVING ANGLED RECEPTACLE GUIDE FRAMES

(75) Inventors: Matthew Ryan Schmitt, Middletown, PA (US); John Timothy Lippert, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 223 days.

(21) Appl. No.: 13/546,723

(22) Filed: Jul. 11, 2012
(Under 37 CFR 1.47)

(65) Prior Publication Data

US 2014/0017949 A1 Jan. 16, 2014

(51) Int. Cl.
*H01R 13/66* (2006.01)
*H01R 24/76* (2011.01)
*H01R 13/659* (2011.01)

(52) U.S. Cl.
CPC ..... *H01R 24/76* (2013.01); *H01R 13/659* (2013.01)
USPC ..... 439/540.1

(58) Field of Classification Search
USPC ..... 439/540.1, 607.21, 541.5
See application file for complete search history.

(56) References Cited

U.S. PATENT DOCUMENTS 4,386,814 A * 6/1983 Asick ..... 439/607.28
5,011,257 A 4/1991 Wettengel et al.
5,766,041 A * 6/1998 Morin et al. ..... 439/607.19
6,146,192 A * 11/2000 Cabalka et al. ..... 439/540.1
6,304,436 B1 * 10/2001 Branch et al. ..... 361/753
6,478,622 B1 * 11/2002 Hwang ..... 439/607.2
6,517,382 B2 * 2/2003 Flickinger et al. ..... 439/607.23
6,537,106 B1 3/2003 Follingstad
6,558,191 B2 * 5/2003 Bright et al. ..... 439/541.5
6,600,865 B2 * 7/2003 Hwang ..... 385/134
6,824,429 B2 * 11/2004 Hwang ..... 439/607.2
6,866,544 B1 * 3/2005 Casey et al. ..... 439/607.2
7,044,763 B1 * 5/2006 Inoue et al. ..... 439/326
7,070,446 B2 * 7/2006 Henry et al. ..... 439/541.5
7,094,095 B1 8/2006 Caveney
7,273,399 B2 * 9/2007 LeGrow et al. ..... 439/620.2
7,322,854 B2 * 1/2008 Long et al. ..... 439/607.28
7,343,078 B2 3/2008 Spisany et al.
7,357,673 B2 * 4/2008 Long ..... 439/607.2
7,438,596 B2 * 10/2008 Phillips ..... 439/607.01
7,488,212 B2 * 2/2009 Chen ..... 439/607.01
7,529,458 B2 * 5/2009 Spisany et al. ..... 385/137
7,722,392 B2 * 5/2010 Lee et al. ..... 439/540.1
7,738,262 B2 * 6/2010 Sato et al. ..... 361/816
7,867,022 B2 * 1/2011 Davison et al. ..... 439/540.1
7,869,224 B1 * 1/2011 Yang ..... 361/800
7,896,659 B1 * 3/2011 Westman et al. ..... 439/75

(Continued)

*Primary Examiner* — Neil Abrams

(57) ABSTRACT

A receptacle assembly includes multiple receptacle guide frames configured to be coupled to a host board. Each receptacle guide frame has a front end and a back end. A receptacle extends from the front end to the back end of each receptacle guide frame. Each receptacle has an open end positioned at the front end of the receptacle guide frame and a closed end positioned at the back end of the receptacle guide frame. Each receptacle guide frame is configured to be aligned with an opening in a panel so that the receptacle is accessible through the opening. A host board connector is positioned at the closed end of each receptacle. Each host board connector includes a mating face. Each receptacle guide frame is aligned with the opening in the panel so that the mating face of each host board connector is positioned at a non-orthogonal angle with respect to the panel.

20 Claims, 6 Drawing Sheets

(56) References Cited

U.S. PATENT DOCUMENTS

| | | | | |
|---|---|---|---|---|
| 8,182,290 | B2 * | 5/2012 | Fonteneau et al. | 439/607.21 |
| 8,187,027 | B2 * | 5/2012 | Follingstad | 439/534 |
| 8,197,282 | B1 * | 6/2012 | Su et al. | 439/541.5 |
| 8,203,084 | B2 * | 6/2012 | Wertz et al. | 174/368 |
| 8,426,751 | B2 * | 4/2013 | Lee et al. | 174/520 |
| 8,449,203 | B2 * | 5/2013 | Downs | 385/92 |
| 8,465,320 | B2 * | 6/2013 | Long | 439/541.5 |
| 8,469,738 | B2 * | 6/2013 | Long | 439/541.5 |
| 8,469,744 | B2 * | 6/2013 | Nichols et al. | 439/607.01 |
| 8,500,490 | B2 * | 8/2013 | Tsou | 439/607.55 |
| 8,545,268 | B2 * | 10/2013 | Fogg et al. | 439/607.25 |
| 8,585,437 | B2 * | 11/2013 | Lin | 439/540.1 |
| 2004/0072467 | A1 * | 4/2004 | Jordan et al. | 439/492 |
| 2014/0017949 | A1 * | 1/2014 | Schmitt et al. | 439/629 |

* cited by examiner

RECEPTACLE ASSEMBLY HAVING ANGLED RECEPTACLE GUIDE FRAMES

BACKGROUND OF THE INVENTION

The subject matter described herein relates generally to receptacle assemblies, and more particularly, to receptacle assemblies having angled receptacle guide frames.

Electrical assemblies generally include a host board that is positioned adjacent to a panel within a chassis. The panel includes an opening that enables access to the host board. In particular, the host board may include a receptacle assembly coupled thereto. The receptacle assembly includes receptacle guide frames having host board connectors that electrically couple to the host board. The host board connectors may be copper-based connectors, fiber optic connectors, or the like. The receptacle guide frames extend through the opening in the panel so that the host board connectors may receive a plug, jack, or module that electrically couples a peripheral device to the host board.

Generally, the receptacle assembly includes multiple receptacle guide frames that each define a receptacle. The receptacles have an open end and a closed end. The host board connectors are positioned at the closed ends of the receptacles and are accessible through the open ends of the receptacles. The receptacle guide frames are coupled to the host board so that the open end of each receptacle extends through the opening in the panel. The receptacle guide frames are positioned so that the open end of each receptacle extends parallel to the panel. Some receptacle assemblies may also include a light pipe coupled to each receptacle guide frame and extending through the panel. The light pipe provides a signal indicative of an electrical connection to the host board connector and/or traffic through the host board connector.

However, conventional receptacle assemblies are not without their disadvantages. Generally, the receptacle assemblies are positioned in racks including several receptacle assemblies. Accordingly, several cables are connected to the electrical assembly. As such, cable management may be become difficult when making electrical connections with the electrical assembly. Often, cables from peripheral devices that have been connected to a host board connector may block other receptacles in the electrical assembly. Additionally, the cables may block the light pipes of other receptacle guide frames thereby preventing visual confirmation of the electrical connection and/or traffic through the host board connectors. The configuration of the receptacle assemblies may result in improper connections made between the cables and the electrical assembly and/or may increase the time required to couple peripheral devices to the electrical assembly.

A need remains for a connector assembly that improves the cable management of cables connected to the electrical assembly.

SUMMARY OF THE INVENTION

In one embodiment, a receptacle assembly is provided. The assembly includes multiple receptacle guide frames arranged adjacent to one another. The receptacle guide frames are configured to be coupled to a host board. Each receptacle guide frame has a front end and a back end. A receptacle extends from the front end to the back end of each receptacle guide frame. Each receptacle has an open end positioned at the front end of the receptacle guide frame and a closed end positioned at the back end of the receptacle guide frame. Each receptacle guide frame is configured to be aligned with an opening in a panel so that the receptacle is accessible through the opening. A host board connector is positioned at the closed end of each receptacle. Each host board connector includes a mating face. Each receptacle guide frame is aligned with the opening in the panel so that the mating face of each host board connector is positioned at a non-orthogonal angle with respect to the panel.

In another embodiment, an electrical assembly is provided. The electrical assembly includes a host board having an outer edge configured to be positioned adjacent to a panel. Multiple receptacle guide frames are arranged adjacent to one another. The receptacle guide frames are coupled to the host board. Each receptacle guide frame has a front end and a back end. A receptacle extends from the front end to the back end of each receptacle guide frame. Each receptacle has an open end positioned at the front end of the receptacle guide frame and a closed end positioned at the back end of the receptacle guide frame. A host board connector is positioned at the closed end of each receptacle. Each host board connector includes a mating face. Each receptacle guide frame is coupled to the host board so that the mating face of each host board connector is positioned at a non-orthogonal angle with respect to the outer edge of the host board.

In another embodiment, an electrical assembly is provided. The assembly includes a host board having an outer edge. A panel is positioned adjacent to the outer edge of the host board. The panel has an opening extending therethrough. Multiple receptacle guide frames are arranged adjacent to one another. The receptacle guide frames are coupled to the host board. Each receptacle guide frame has a front end and a back end. A receptacle extends from the front end to the back end of each receptacle guide frame. Each receptacle has an open end positioned at the front end of the receptacle guide frame and a closed end positioned at the back end of the receptacle guide frame. A host board connector is positioned at the closed end of each receptacle. Each host board connector includes a mating face. Each receptacle guide frame is coupled to the host board so that the mating face of each host board connector is positioned at a non-orthogonal angle with respect to the panel.

DETAILED DESCRIPTION OF THE INVENTION

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
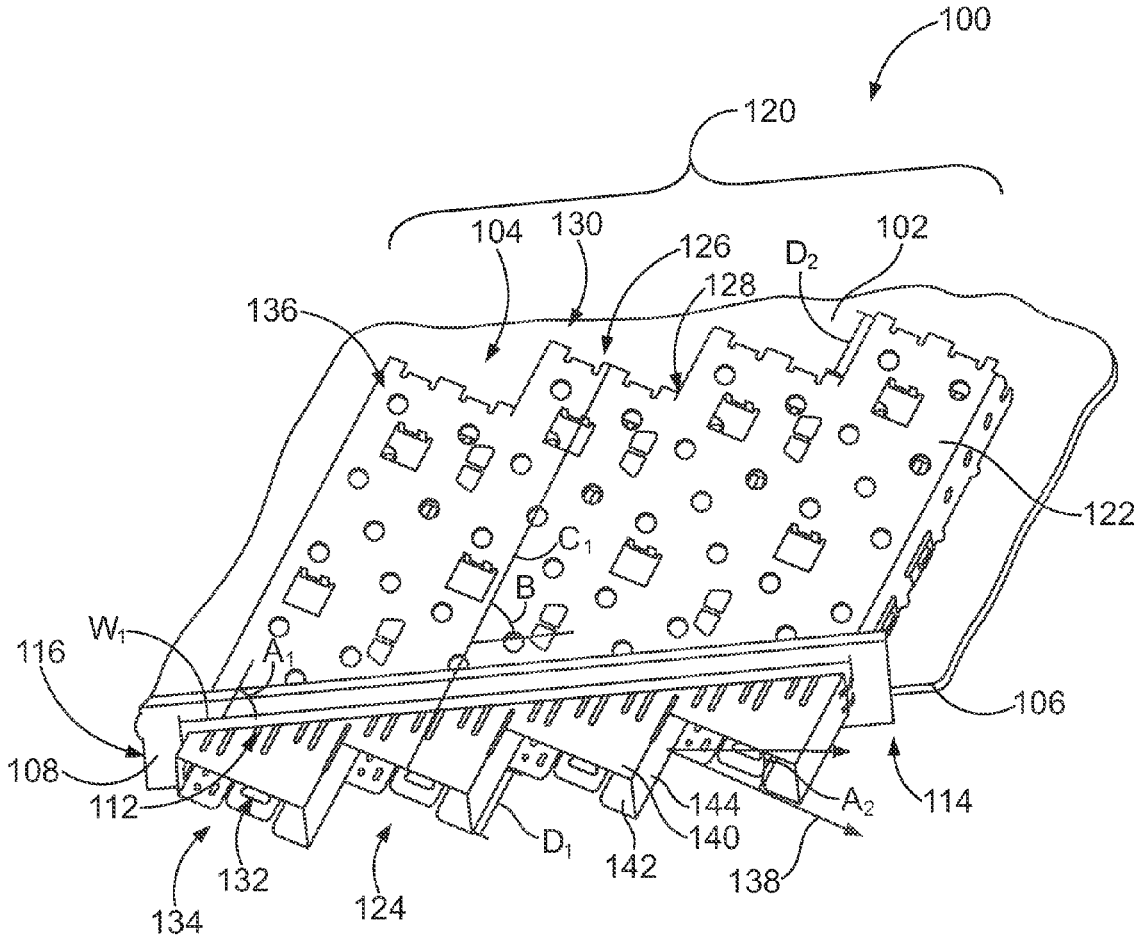
FIG. 1 is a top perspective view of an electrical assembly formed in accordance with an embodiment.

FIG. 1 is a top perspective view of an electrical assembly 100 formed in accordance with an embodiment. The electrical assembly 100 may be part of an equipment rack that includes multiple electrical assemblies 100. The electrical assembly 100 includes a host board 102. The host board 102 may be a circuit board, a printed circuit board, or the like. The host board 102 may be a motherboard, daughter card, backplane, midplane, or the like. The host board 102 includes a top surface 104 configured to have electrical components coupled thereto. The host board 102 includes an outer edge 106. The top surface 104 extends from the outer edge 106 to a back edge (not shown). The top surface 104 also extends between side edges (not shown) that extend between the outer edge 106 and the back edge.

A panel 108 extends parallel to the outer edge 106 of the host board 102. The panel 108 may be a bezel or the like. The panel 108 may be part of a chassis within a rack system of a network server or switch. In the illustrated embodiment, the panel 108 is spaced a distance from the outer edge 106 of the host board 102. Optionally, the panel 108 may abut the outer edge 106 of the hostboard 102. The panel 108 includes an opening 112 extending therethrough. The opening 112 is aligned above the top surface 104 of the host board 102. The opening 112 provides access to the electrical components coupled to the top surface 104 of the host board 102. The opening 112 extends a width $W_1$ between a first side 114 and a second side 116 of the panel 108. The opening 112 may extend any distance between the first side 114 and the second side 116 of the panel 108. The opening 112 may be configured to receive electrical components, cables, or the like therethrough.

A receptacle assembly 120 is coupled to the top surface 104 of the host board 102. The receptacle assembly 120 includes multiple receptacle guide frames 122 positioned adjacent to one another. Optionally, the multiple receptacle guide frames 122 may be ganged together to form a single unit that may be mounted to the host board 106 and into the panel 108 as a single component. The receptacle guide frames 122 may include common stamped metal sheets that form one or more walls of the guide frames 122. For example, each of the guide frames 122 may share a common top cage 140 and/or bottom cage 142 with separator walls 144 therebetween.

Each receptacle guide frame has a front end 124 and a back end 126. Each receptacle guide frame 122 has a first side 128 and a second side 130. Each receptacle guide frame 122 is coupled to the top surface 104 of the host board 102. The back end 126 of each receptacle guide frame 122 is positioned distally from the outer edge 106 of the host board 102. The front end 124 of each receptacle guide frame 122 is positioned proximate to the outer edge 106 of the host board 102. In the illustrated embodiment, the front end 124 of each receptacle guide frame 122 extends past the outer edge 106 of the host board 102. The front end 124 of each receptacle guide frame 122 extends through the opening 112 in the panel 108. The receptacle guide frames 122 collectively have a width that is approximately equal to the width $W_1$ of the opening 112 in the panel 108. The collective width of the receptacle guide frames 122 is defined at an angle $A_1$ with respect to the front end 124 and the back end 126 of each receptacle guide frame 122. The collective width of the receptacle guide frames 122 is defined as being parallel to the panel 108 and the outer edge 106 of the host board 102. The collective width of the receptacle guide frames is defined so that the front end 124 of each receptacle guide frame 122 can be received through the opening 112 in the panel 108.

Each receptacle guide frame 122 includes coupling mechanisms 133 positioned proximate to the front end 124 of the receptacle guide frame 122. The coupling mechanisms 133 are configured to engage the panel 108 to secure the receptacle guide frame 122 to the panel 108.

The front ends 124 of the receptacle guide frames 122 are arranged in a stepped configuration. The front ends 124 of the receptacle guide frames 122 are offset from one another. The front end 124 of each receptacle guide frame 122 is positioned a distance $D_1$ from the front end 124 of each adjacent receptacle guide frame 122. The distance $D_1$ may be uniform between each adjacent receptacle guide frame 122. Alternatively, the distance $D_1$ may vary between each adjacent receptacle guide frame 122. The back end 126 of each receptacle guide frame 122 is positioned a distance $D_2$ from the back end 126 of each adjacent receptacle guide frame 122. The distance $D_2$ may be uniform between each adjacent receptacle guide frame 122. Alternatively, the distance $D_2$ may vary between each adjacent receptacle guide frame 122. In the illustrated embodiment, the distance $D_2$ is equal to the distance $D_1$.

The front end 124 of each receptacle guide frame 122 extends in a plane 138. Optionally, the plane 138 defined by each receptacle guide frame 122 may be parallel to the plane 138 defined by the other receptacle guide frames 122. Alternatively, the planes 138 may be at different angles. The plane 138 defined by each receptacle guide frame 122 extends at a non-orthogonal angle $A_2$ with respect to the outer edge 106 of the host board 102. The plane 138 defined by each receptacle guide frame 122 also extends at the angle $A_2$ with respect to the panel 108. The front ends 124 of the receptacle guide frames 122 are angled with respect to the panel 108 and the outer edge 106 of the host board 102 to facilitate cable management when connecting cables to the receptacle guide frames 122.

Each receptacle guide frame 122 is elongated along a central axis $C_1$ defined between the front end 124 and the back end 126 of the receptacle guide frame 122. The central axes $C_1$ of the receptacle guide frames 122 are perpendicular to the planes 138 defined by the front end 124 of each receptacle guide frame 122. The central axes $C_1$ extend at a non-orthogonal angle B with respect to the outer edge 106 of the host board 102. The central axes $C_1$ also extend at the angle B with respect to the panel 108. The central axes $C_1$ of the receptacle guide frames 122 are angled with respect to the panel 108 and the outer edge 106 of the host board 102 to facilitate cable management when connecting cables to the receptacle guide frames 122.

Each receptacle guide frame 122 includes a receptacle 132. The receptacles 132 extend between the front end 124 and the back end 126 of the respective receptacle guide frame 122. The receptacles 132 include an open end 134 positioned at the front end 124 of the receptacle guide frame 122. The receptacles 132 include a closed end 136 positioned at the back end 126 of the receptacle guide frame 122. The open end 134 of each receptacle 132 extends through the opening 112 in the panel 108.

Figure 2:
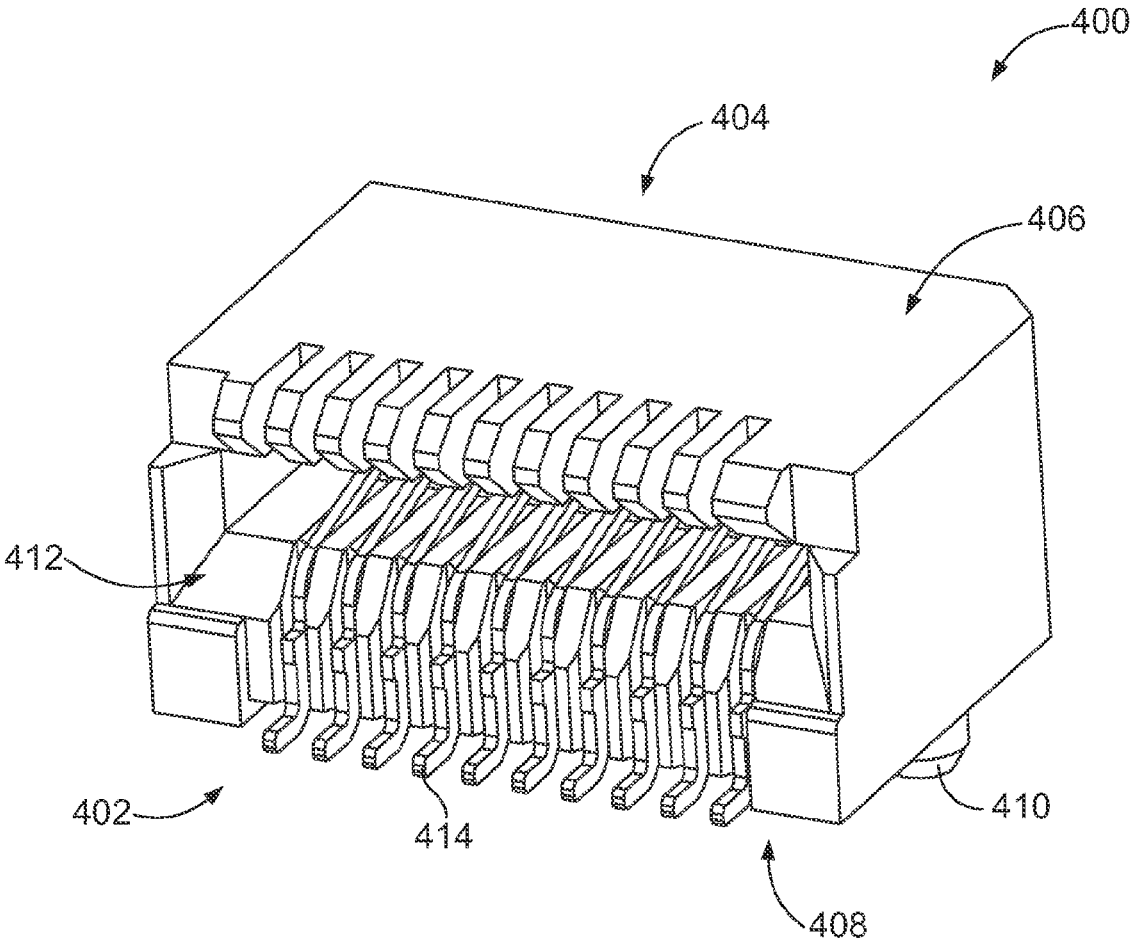
FIG. 2 is a front perspective view of a host board connector formed in accordance with an embodiment.

FIG. 2 is a front perspective view of a host board connector 400 formed in accordance with an embodiment. The host board connector 400 includes a mating end 402 and a rear end 404. A top 406 and a bottom 408 extend between the mating end 402 and the rear end 404. The host board connector 400 is configured to be positioned in a receptacle 132 (shown in FIG. 1). The bottom 408 of the host board connector 400 includes pins 410 extending therefrom. The pins 410 are configured to be received in openings formed in the receptacle guide frame 122 (shown in FIG. 1) to secure the host board connector 400 in the receptacle guide frame 122. In one embodiment, the pins 410 may also be received in apertures formed in the host board 102 to secure the host board connector 400 to the host board 102.

The mating end 402 of the host board connector 400 forms a mating face 412. Contacts 414 extend along the mating face 412. The connector 400 is configured to electrically couple to the host board 102 so that the contacts 414 are electrically coupled to the host board 102. The contacts 414 may be configured to receive copper-based connectors, fiber optic connectors, or the like. In one embodiment, the contacts 414 are configured to receive contacts of a module (not shown) that is received in the receptacle 132. The module may be a transceiver or the like. The module may be configured to receive cables or the like from peripheral devices. The connector 400 electrically couples the peripheral devices to the host board 102.

Figure 3:
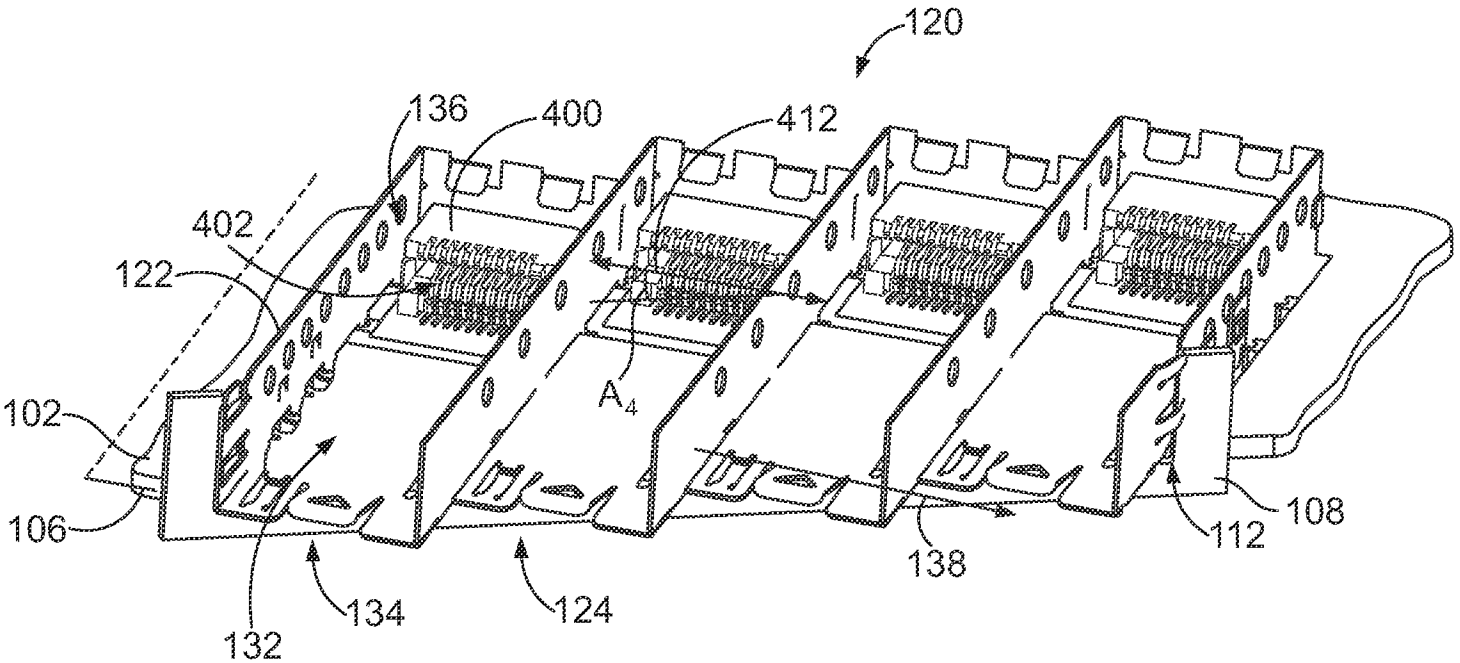
FIG. 3 is a cut-away view of the electrical assembly shown in FIG. 1 and having host board connectors shown in FIG. 2 positioned therein.

FIG. 3 is a cut-away view of the receptacle assembly 120 having the host board connectors 400 positioned therein. The host board connectors 400 are positioned at the closed end 136 of the receptacle 132. The host board connectors 400 are positioned so that the mating end 402 of the host board connector 400 faces the open end 134 of the receptacle. The mating end 402 of the host board connector 400 is accessible through the open end 134 of the receptacle. The mating end 402 of the host board connector 400 is accessible through the opening 112 in the panel 108.

The mating face 412 of each connector 400 is positioned proximate to the closed end 136 of the receptacle 132. In an alternative embodiment, the connectors 400 may be positioned at the open end 134 of the receptacle 132 so that the mating face 412 extends past the front end 124 of the receptacle guide frame 122. The mating face 412 extends parallel to the plane 138 defined by the front end 124 of the receptacle guide frame 122. The mating face 412 extends perpendicular to the central axis $C_1$ of the receptacle guide frame 122. The mating face 412 of each connector 400 extends at a non-orthogonal angle $A_4$ with respect to the outer edge 106 of the host board 102. The mating face 412 of each connector 400 also extends at the angle $A_4$ with respect to the panel 108. The mating face 412 of each connector 400 is angled with respect to the panel 108 and the outer edge 106 of the host board 102 to facilitate cable management when connecting cables to the connectors 400. The connectors 400 and the receptacles 132 are angled so that cables connected to the connectors 400 do not block connectors 400 and receptacles 132 of neighboring electrical assemblies 100.

Figure 4:
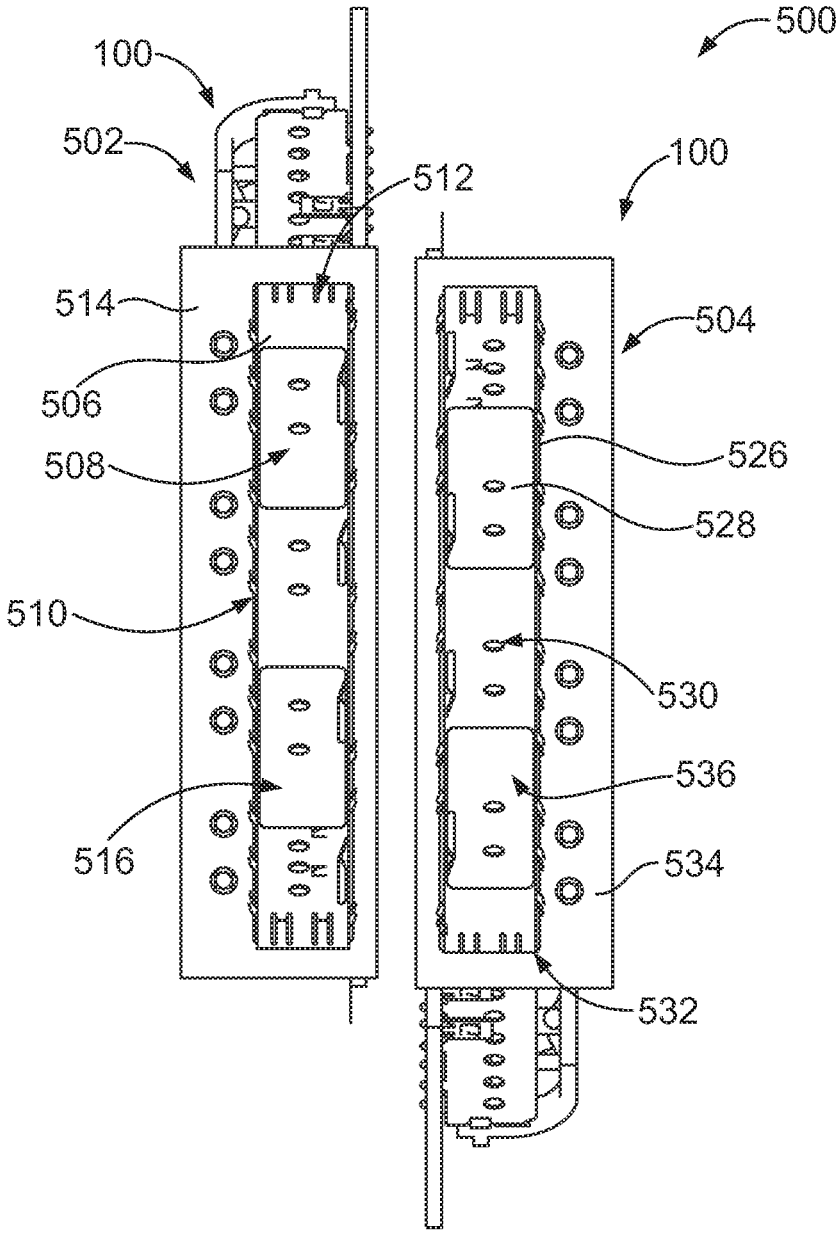
FIG. 4 is a front view of a rack formed in accordance with an embodiment.

FIG. 4 is a front view of a rack 500 including two electrical assemblies 100. The rack 500 includes a first electrical assembly 502 and a second electrical assembly 504 positioned adjacent to the first electrical assembly 502. The first electrical assembly 502 includes multiple receptacle guide frames 506 arranged in a column. Each receptacle guide frame 506 includes a receptacle 508 extending therethrough. The receptacle guide frames 506 include a front end 510 aligned with an opening 512 in a bezel 514. The front end 510 of each receptacle guide frame 506 is angled downward at a non-orthogonal angle. Each receptacle 508 includes an open end 516 at the front end 510 of the receptacle guide frame 506. The open end 516 of each receptacle 508 is angled downward.

The second electrical assembly 504 includes multiple receptacle guide frames 526 arranged in a column. Each receptacle guide frame 526 includes a receptacle 528 extending therethrough. The receptacle guide frames 526 include a front end 530 aligned with an opening 532 in a bezel 534. The front end 530 of each receptacle guide frame 526 is angled upward a non-orthogonal angle. The front end 530 of each receptacle guide frame 526 is angled opposite the angle of the front ends 510 of the receptacle guide frames 506 of the first electrical assembly 502. Each receptacle 528 includes an open end 536 at the front end 530 of the receptacle guide frame 526. The open end 536 of each receptacle 528 is angled upward. The open end 536 of each receptacle 528 is angled opposite the angle of the open end 516 of the receptacles 508 of the first electrical assembly 502.

The electrical assemblies 100 include angled receptacle guide frames to facilitate cable management when coupling peripheral devices to the host board connectors. The receptacle guide frames are angled so that the cables coupled to the rack do not block the receptacles of neighboring electrically assemblies. It should be noted that the electrical assemblies 502 and 504 are illustrated as being angled in opposite directions. In one embodiment, the first electrical assembly 502 and the second electrical assembly 504 may each be angled upward. Optionally, the first electrical assembly 502 and the second electrical assembly 504 may each be angled downward. In one embodiment, the rack 500 includes any number of electrical assemblies 100 angled upward and/or downward.

Figure 5:
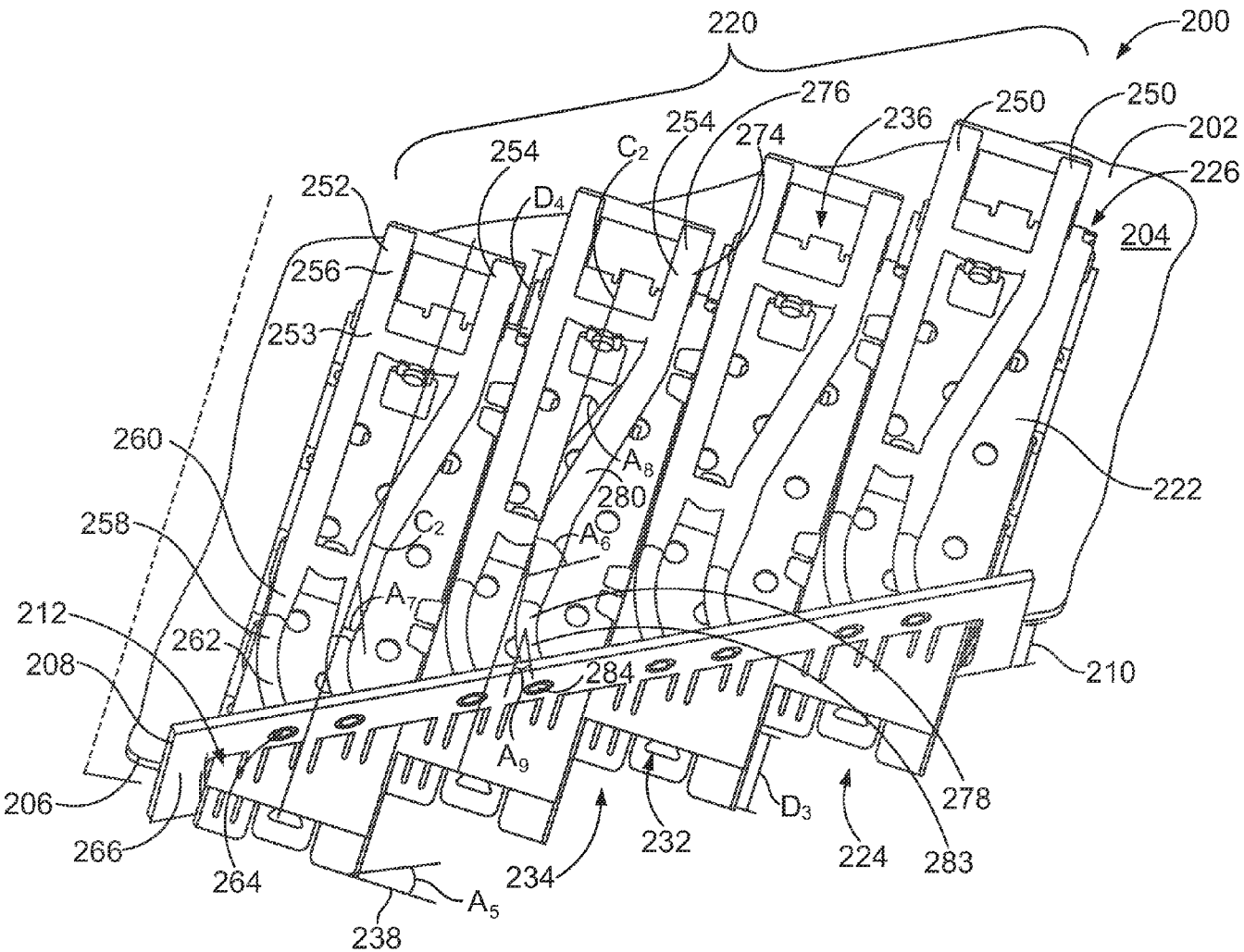
FIG. 5 is a top perspective view of an electrical assembly formed in accordance with another embodiment.

FIG. 5 is a top perspective view of an electrical assembly 200 formed in accordance with another embodiment. The electrical assembly 200 includes a host board 202. The host board 202 includes a top surface 204 configured to have electrical components coupled thereto. The host board 202 includes an outer edge 206.

A panel 208 extends parallel to the outer edge 206 of the host board 202. In the illustrated embodiment, the panel 208 is spaced a distance 210 from the outer edge 206 of the host board 202. Optionally, the panel 208 may abut the outer edge 206 of the host board 202. The panel 208 includes an opening 212 extending therethrough.

A receptacle assembly 220 is coupled to the top surface 204 of the host board 202. The receptacle assembly 220 includes multiple receptacle guide frames 222 having a front end 224 and a back end 226. Each receptacle guide frame 222 is coupled to the top surface 204 of the host board 202. The back end 226 of each receptacle guide frame 222 is positioned distally from the outer edge 206 of the host board 202. The front end 224 of each receptacle guide frame 222 is positioned proximate to the outer edge 206 of the host board 202. In the illustrated embodiment, the front end 224 of each receptacle guide frame 222 extends past the outer edge 206 of the host board 202. The front end 224 of each receptacle guide frame 222 extends through the opening 212 in the panel 208. The front end 224 of each receptacle guide frame 222 extends past the opening 212 in the panel 208.

Each receptacle guide frame 222 includes a receptacle 232 extending between the front end 224 and the back end 226 of the receptacle guide frame 222. The receptacles 232 include an open end 234 positioned at the front end 224 of the receptacle guide frame 222. The receptacles 232 include a closed end 236 positioned at the back end 226 of the receptacle guide frame 222. The open end 234 of each receptacle 232 extends through the opening 212 in the panel 208. The open end 234 of each receptacle 232 extends past the opening 212 in the panel 208.

The front ends 224 of the receptacle guide frames 222 are arranged in a stepped configuration. The front end 224 of each receptacle guide frame 222 is positioned a distance $D_3$ from the front end 224 of each adjacent receptacle guide frame 222. The distance $D_3$ may be uniform between each adjacent receptacle guide frame 222. Alternatively, the distance $D_3$ may vary between each adjacent receptacle guide frame 222. The back end 226 of each receptacle guide frame 222 is positioned a distance $D_4$ from the back end 226 of each adjacent receptacle guide frame 222. The distance $D_4$ may be uniform between each adjacent receptacle guide frame 222. Alternatively, the distance $D_4$ may vary between each adjacent receptacle guide frame 222. In the illustrated embodiment, the distance $D_4$ is equal to the distance $D_3$.

The front end 224 of each receptacle guide frame 222 extends in a plane 238. The plane 238 defined by each receptacle guide frame 222 is parallel to the plane 238 defined by the other receptacle guide frames 222. The plane 238 defined by each receptacle guide frame 222 extends at a non-orthogonal angle $A_5$ with respect to the outer edge 206 of the host board 202 and the panel 208. The front ends 224 of the receptacle guide frames 222 are angled with respect to the panel 208 and the outer edge 206 of the host board 202 to facilitate cable management when connecting cables to the receptacle guide frame 222.

Each receptacle guide frame 222 includes a central axis $C_2$. The central axis $C_2$ extends between the front end 224 and the back end 226 of the receptacle guide frame 222. The central axes $C_2$ are perpendicular to the planes 238 defined by the front end 224 of each receptacle guide frame 222. The central axes $C_2$ extend at a non-orthogonal angle $A_6$ with respect to the outer edge 206 of the host board 202 and the panel 208. The central axes $C_2$ of the receptacle guide frames 222 are angled with respect to the panel 208 and the outer edge 206 of the host board 202 to facilitate cable management when connecting cables to the receptacle guide frames 222.

The electrical assembly 200 includes light pipes 250 extending over each receptacle guide frame 222. The light pipes 250 are configured to direct lighting signals indicative of a connection with the receptacle assembly 220 and/or traffic, for example data and/or power signals, through the receptacle assembly 220. In the illustrated embodiment, the light pipes 250 are configured in pairs that include a first light pipe 252 and a second light pipe 254. A pair of light pipes 250 extends over each receptacle guide frame 222 of the receptacle assembly 220. Optionally, the receptacle assembly 220 may include any number of light pipes 250.

The first light pipe 252 includes a board portion 253. A first end 256 of the board portion 253 is joined to the host board 202 proximate to the back end 226 of the receptacle guide frame 222. The host board 202 includes a light source (not shown), for example, an LED that is coupled to the first end 256 of the board portion 253 of the first light pipe 252. The board portion 253 of the first light pipe 252 extends over the receptacle guide frame 222 parallel to the central axis $C_2$. An intermediate portion 258 is joined to a second end 260 of the board portion 253 proximate to the front end 224 of the receptacle guide frame 222. The intermediate portion 258 is bent at an angle. An end portion 262 of the first light pipe 252 extends from the intermediate portion 258 to the panel 208. The end portion 262 extends perpendicular with respect to the panel 208. The end portion 262 extends at a non-orthogonal angle $A_7$ with respect to the central axis $C_2$. The end portion 262 extends through the panel 208. The end portion 262 includes an end surface 264 that is positioned flush with an outer surface 266 of the panel 208. Alternatively, the end surface 264 may extend past the outer surface 266 of the panel 208 or be recessed with respect to the outer surface 266 of the panel 208.

The second light pipe 254 includes a board portion 274. A first end 276 of the board portion 274 is joined to the host board 202 proximate to the back end 226 of the receptacle guide frame 222. The host board 202 includes a light source (not shown), for example, an LED that is coupled to the first end 276 of the board portion 274 of the second light pipe 254. The first end 276 of the board portion 274 of the second light pipe 254 extends over the receptacle guide frame 222 parallel to the central axis $C_2$. A second end 280 of the board portion 274 extends at a non-orthogonal angle $A_8$ with respect to the central axis $C_2$. An intermediate portion 278 is joined to a second end 280 of the board portion 274 proximate to the front end 224 of the receptacle guide frame 222. The intermediate portion 278 is bent at an angle. An end portion 283 of the second light pipe 254 extends from the intermediate portion 282 to the panel 208. The end portion 283 extends perpendicular with respect to the panel 208. The end portion 283 extends at a non-orthogonal angle $A_9$ with respect to the central axis $C_2$. The end portion 283 extends through the panel 208. The end portion 283 includes an end surface 284 that is positioned flush with the outer surface 266 of the panel 208. Alternatively, the end surface 284 may extend past the outer surface 266 of the panel 208 or be recessed with respect to the outer surface 266 of the panel 208.

The end surfaces 264 and 284 of the first light pipe 252 and the second light pipe 254, respectively, are positioned flush with the outer surface 266 of the panel 208 to facilitate providing visual confirmation of a connection with the receptacle assembly 220 and/or traffic through the receptacle assembly 220. The front ends 224 of the receptacle guide frame 222 are angled with respect to the outer surface 266 of the panel 208 so that cables connected to the receptacle guide frame 222 do not interfere with and/or cover the end surfaces 264 and 284 of the first light pipe 252 and the second light pipe 254, respectively.

The end surfaces 264 and 284 of the first light pipe 252 and the second light pipe 254, respectively, are positioned above the receptacles 232. A first light pipe 252 and a second light pipe 254 are positioned above each receptacle 232. The light pipes 252 and 254 direct a light signal to the end surfaces 264 and 284 thereof. The light signal is indicative of an electrical connection to a host board connector (not shown) positioned in the receptacle 232. The light signal may indicate that electrical signals are being transmitted through the host board connector. For example, the light signal may indicate that data and/or power signals are being transmitted through the host board connector between the host board 202 and a peripheral device. The receptacles 232 are angled with respect to the panel 208 so that cables connected to the host board connectors do not block the end surfaces 264 and 284 of the first light pipe 252 and the second light pipe 254, respectively, of neighboring electrical assemblies 200.

Figure 6:
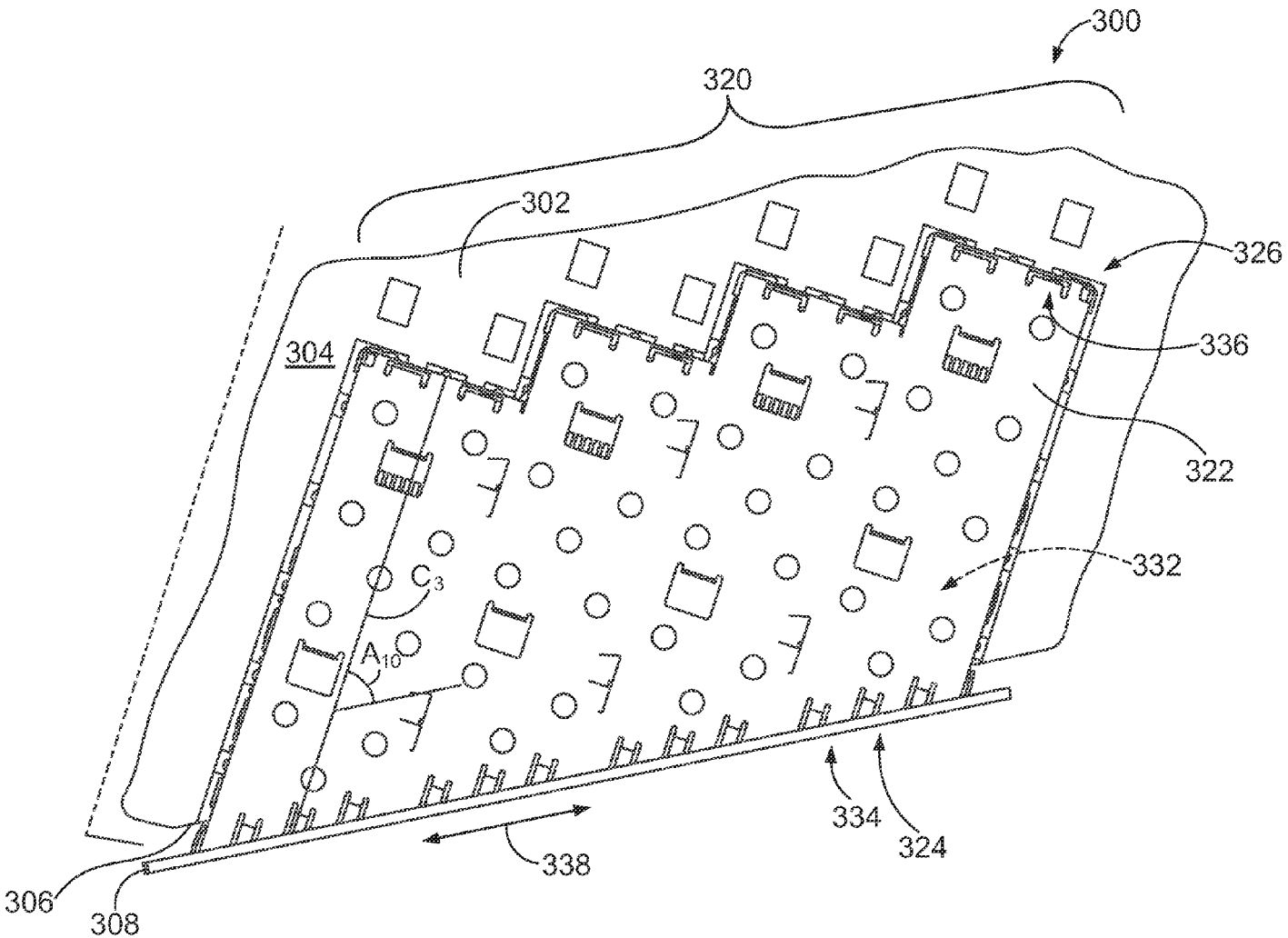
FIG. 6 is a top view of an electrical assembly formed in accordance with another embodiment.

FIG. 6 is a top perspective view of an electrical assembly 300 formed in accordance with another embodiment. The electrical assembly 300 includes a host board 302 having a top surface 304 and an outer edge 306. A panel 308 extends parallel to the outer edge 306 of the host board 302. The panel 308 includes an opening (not shown) extending therethrough.

A receptacle assembly 320 is coupled to the top surface 304 of the host board 302. The receptacle assembly 320 includes multiple receptacle guide frames 322 having a front end 324 and a back end 326. The front end 324 of each receptacle guide frame 322 is positioned proximate to the outer edge 306 of the host board 302. The front end 324 of each receptacle guide frame 322 is positioned behind the panel 308. The front end 324 of each receptacle guide frame 322 is aligned with the opening in the panel 308. The front end 324 of each receptacle guide frame 322 is positioned behind the panel 308. The front end 324 of each receptacle guide frame 322 is accessible through the opening in the panel 308.

Each receptacle guide frame 322 includes a receptacles 332 receptacles 332 receptacle 332 extending between the front end 324 and the back end 326 of the receptacle guide frame 322. The receptacles 332 include an open end 334 positioned at the front end 324 of the receptacle guide frame 322. The receptacles 332 include a closed end 336 positioned at the back end 326 of the receptacle guide frame 322. The open end 334 of each receptacle 332 is aligned with the opening in the panel 308 so that the open end 334 of each receptacle 332 is accessible through the opening in the panel 308.

The front ends 324 of the receptacle guide frames 322 are arranged in a stepped configuration. The back end 226 of each receptacle guide frame 322 is likewise arranged in a stepped configuration. The front end 324 of each receptacle guide frame 322 extends in a plane 338. The plane 338 defined by each receptacle guide frame 322 is parallel to the plane 338 defined by the other receptacle guide frames 322. The plane 338 defined by each receptacle guide frame 322 extends parallel to the outer edge 306 of the host board 302 and the panel 308.

Each receptacle guide frame 322 includes a central axis $C_3$. The central axis $C_3$ extends between the front end 324 and the back end 326 of the receptacle guide frame 322. The central axes $C_3$ extend at a non-orthogonal angle $A_{10}$ with respect to the outer edge 306 of the host board 302 and the panel 308. The central axes $C_3$ of the receptacle guide frames 322 are angled with respect to the panel 308 and the outer edge 306 of the host board 302 to facilitate cable management when connecting cables to the receptacle guide frames 322.

The electrical assemblies 100, 200, and 300 are configured to be utilized in equipment racks that may include multiple electrical assemblies 100, 200, and 300. The equipment racks may use any combination of electrical assemblies 100, 200, and 300. The electrical assemblies 100, 200, and 300 include angled receptacle guide frames to facilitate cable management when coupling peripheral devices to the connectors. The receptacle guide frames are angled so that the cables coupled to an electrical assembly do not block the receptacle guide frames and/or light pipes of neighboring electrically assemblies.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A receptacle assembly comprising:

receptacle guide frames configured to be coupled to a host board, the receptacle guide frames having a common top cage and separator walls extending between a front end and a back end to define a plurality of receptacles adjacent to one another and ganged together, the common top cage spanning across each of the receptacles and the separator walls separating the adjacent receptacles; and each receptacle extending from the front end to the back end, each receptacle having an open end positioned at the front end of the receptacle guide frame and a closed end positioned at the back end of the receptacle guide frame, the receptacle guide frames extending through an opening in a panel so that the receptacles are accessible through the opening, the receptacles being angled at non-orthogonal angles relative to the panel; and host board connectors positioned at the closed end of each corresponding receptacle, each host board connector including a mating face, wherein the mating face of each host board connector is positioned at a non-orthogonal angle with respect to the panel.

2. The receptacle assembly of claim 1, wherein each receptacle guide frame is elongated along a central axis extending from the front end to the back end of the receptacle guide frame, each receptacle guide frame aligned with the opening in the panel so that the central axis of each receptacle guide frame is positioned at a non-orthogonal angle with respect to the panel.

3. The receptacle assembly of claim 1, wherein a plane is defined by the front end of each receptacle guide frame, the planes extending parallel to one another, wherein each receptacle guide frame is aligned with the opening in the panel so that the planes formed by the front end of each receptacle guide frame extend at a non-orthogonal angle with respect to the panel.

4. The receptacle assembly of claim 1, wherein the top cage at the front end of each receptacle guide frame includes front edges, the front edges being non-contiguous and angled at non-orthogonal angles with respect to the panel.

5. The receptacle assembly of claim 1, wherein the top cage includes at least one coupling mechanism extending therefrom proximate to the front end, the at least one coupling mechanism being positioned in the opening in the panel to directly electrically connect the top cage to the panel.

6. The receptacle assembly of claim 1, wherein each of the receptacle guide frames includes a light pipe extending along the top cage above the associated receptacle, the light pipe having an end surface positioned in the panel.

7. The receptacle assembly of claim 1, wherein each of the receptacle guide frames includes a light pipe extending along the top cage above the associated receptacle, the light pipe having an end surface positioned flush with an outer surface of the panel.

8. The receptacle assembly of claim 1, wherein each of the receptacle guide frames includes a light pipe extending along the top cage above the associated receptacle, the light pipe having an end portion extending perpendicular with respect to the panel.

9. The receptacle assembly of claim 1, each of the receptacle guide frames includes a light pipe extending along the top cage above the associated receptacle, the light pipe having an end portion extending at an angle with respect to a central axis of the receptacle guide frame.

10. An electrical assembly comprising:

a host board having an outer edge configured to be positioned adjacent to a panel;

multiple receptacle guide frames arranged adjacent to one another and ganged together, the receptacle guide frames coupled to the host board, each receptacle guide frame having a front end and a back end, the receptacle guide frames having a common top cage and separator walls both extending between the front end and the back end to define a plurality of receptacles, the common top cage spanning across each of the receptacles and the separator walls separating the adjacent receptacles, the front ends of the receptacle guide frames being angled at non-orthogonal angles with respect to the outer edge of the host board;

each receptacle extending from the front end to the back end, each receptacle having an open end positioned at the front end of the receptacle guide frame and a closed end positioned at the back end of the receptacle guide frame; and a host board connector positioned at the closed end of each receptacle, each host board connector including a mating face, wherein each receptacle guide frame is coupled to the host board so that the mating face of each host board connector is positioned at a non-orthogonal angle with respect to the outer edge of the host board.

11. The electrical assembly of claim 10, wherein each receptacle guide frame is elongated along a central axis extending from the front end to the back end of the receptacle guide frame, each receptacle guide frame coupled to the host board so that the central axis of each receptacle guide frame is positioned at a non-orthogonal angle with respect to the outer edge of the host board.

12. The electrical assembly of claim 10, wherein the receptacle guide frames comprise a bottom cage being shared by each of the receptacle guide frames, the separator walls extending between the top cage and the bottom cage to separate and define the receptacles.

13. The electrical assembly of claim 10, wherein the front end of each receptacle guide frame is configured to be positioned behind an opening in the panel.

14. The electrical assembly of claim 10, wherein the front end of the receptacle guide frame is configured to extend through an opening in the panel.

15. The electrical assembly of claim 10, wherein at least one of the receptacle guide frames includes a light pipe extending therefrom, the light pipe having an end surface configured to be positioned flush with an outer surface of the panel.

16. The electrical assembly of claim 10, wherein at least one of the receptacle guide frames includes a light pipe extending therefrom, the light pipe having an end portion extending perpendicular with respect to the outer edge of the host board.

17. The electrical assembly of claim 10, wherein at least one of the receptacle guide frames includes a light pipe extending therefrom, the light pipe having an end portion extending at an angle with respect to a central axis of the receptacle guide frame.

18. An electrical assembly comprising:

a host board having an outer edge;

a panel positioned adjacent to the outer edge of the host board, the panel having an opening extending therethrough;

multiple receptacle guide frames arranged adjacent to one another and ganged together, the receptacle guide frames coupled to the host board, each receptacle guide frame having a front end and a back end, the receptacle guide frames including at least one coupling mechanism extending therefrom proximate to the front end, the at least one coupling mechanism being positioned in the opening in the panel to directly electrically connect the receptacle guide frames to the panel;

a receptacle extending from the front end to the back end of each receptacle guide frame, each receptacle having an open end positioned at the front end of the receptacle guide frame and a closed end positioned at the back end of the receptacle guide frame; and a host board connector positioned at the closed end of each receptacle, each host board connector including a mating face, wherein each receptacle guide frame is coupled to the host board so that the mating face of each host board connector is positioned at a non-orthogonal angle with respect to the panel.

19. The electrical assembly of claim 18, wherein each receptacle guide frame is coupled to the host board so that the mating face of each host board connector is positioned at a non-orthogonal angle with respect to the outer edge of the host board.

20. The electrical assembly of claim 18, wherein at least one of the receptacle guide frames includes a light pipe extending therefrom, the light pipe having an end surface configured to be positioned flush with an outer surface of the panel.

* * * * *